United States Patent [19]

Middleton et al.

[11] 4,199,416

[45] Apr. 22, 1980

[54] COMPOSITION FOR THE ELECTROPLATING OF GOLD

[75] Inventors: Harry Middleton; Paul C. Hydes, both of Reading, England

[73] Assignee: Johnson, Matthey & Co., Limited, London, England

[21] Appl. No.: 902,113

[22] Filed: May 2, 1978

[30] Foreign Application Priority Data

May 3, 1977 [GB] United Kingdom ..... 18450/77
Apr. 5, 1978 [GB] United Kingdom ..... 13116/78

[51] Int. Cl.[2] ..... C25D 3/62
[52] U.S. Cl. ..... 204/44; 204/43 G; 204/DIG. 2

[58] Field of Search ..... 204/43 G, 44, 46 G, 204/DIG. 2

[56] References Cited

U.S. PATENT DOCUMENTS

| | | | |
|---|---|---|---|
| 2,090,049 | 8/1937 | Hull | 204/50 Y |
| 2,469,727 | 5/1949 | Hoffman | 204/49 |
| 3,475,292 | 10/1969 | Shoushanian | 204/44 |
| 3,981,782 | 9/1976 | Bradford et al. | 204/46 G |

*Primary Examiner*—G. L. Kaplan
*Attorney, Agent, or Firm*—Cushman, Darby & Cushman

[57] ABSTRACT

A composition of use in compounding an electroplating bath for electrodeposition of gold alloys. The composition contains a nitrosulphite gold complex and at least an alloying agent in the form of a sulphite.

1 Claim, No Drawings

COMPOSITION FOR THE ELECTROPLATING OF GOLD

This invention relates to the electrodeposition of gold and in particular to an improved electrolyte for electrodeposition of gold.

Here and throughout the remainder of this specification and claims, the term "electrodeposition" is to be understood as referring either to electroplating, in which a relatively thin film of metal is electrodeposited onto a supporting substrate, or to electroforming, in which a somewhat thicker film of metal is electrodeposited onto a substrate which is subsequently removed leaving a self-supporting, hollow metal article, or to both, as the context requires.

In order to achieve certain effects by means of gold electroplating, for example on substrates such as an item of jewellery or on metallic spectacle frames, it has hitherto been the usual practice to electroplate a layer of substantially pure gold onto the substrate material followed by a very thin so-called "flash coating" or "gilding deposit" of, for example, an alloy of 50% gold and 50% copper or nickel. The flash coating is translucent, thus creating, in combination with the substantially pure gold layer, the required decorative effect.

The particular alloying metals of the flash coating, and their respective proportions, are selected according to the particular decorative effect desired. The flash coating also serves physically to protect the relatively soft gold layer.

One disadvantage of such a practice is that the flash coating, in order to be translucent, is required to be very thin and it therefore tends to be extremely vulnerable to abrasion, even mild abrasion, with consequent loss or modification, at least in certain areas, of the decorative effect. A further disadvantage of the practice is that the flash coating has hitherto been applied from cyanide-containing electrolytes. These are poisonous and consequently need to be handled with care. They are also rather difficult to dispose of with safety. Yet a further disadvantage of the prior art practice is that the electroplating of the substantially pure gold layer tends to be slow.

We have now found that these and other disadvantages may be overcome by electrodepositing onto a substrate a layer of an alloy of gold. We have found that a fairly thick deposit may thus be applied quickly and the need for a flash coating is therefore eliminated.

According to one aspect of the present invention, a gold alloy electrodeposition electrolyte comprises an aqueous solution of a nitrosulphito gold complex and one or more of the metals copper, nickel, zinc, cobalt, silver, the platinum group metals, cadmium, lead, mercury, arsenic, tin, selenium, tellurium, manganese, indium, antimony, iron, bismuth and thallium, in the form of a compound or complex. By platinum group metals we mean platinum, rhodium, ruthenium, indium, palladium and osmium.

The nitrosulphito gold complex may be prepared in the known manner. The nitrosulphito gold complex is usually associated with the nitrite used in the preparation of the complex. For example, the gold complex formed with sodium nitrite is usually associated with an equimolar amount of sodium nitrite. For use in an electrodeposition bath, it is not necessary to separate the complex from the nitrite used in its preparation and the mixture of complex and nitrite is therefore conveniently referred to as a "gold salt".

The metal compound or complex which is mixed with the gold complex in the electrolyte according to the first aspect of the invention may be added to the electrodeposition bath itself or to the gold complex or gold salt before the bath is made up ready for use. By "plating bath" we mean the entire electrodeposition system, that is to say, including tank, electrolyte, agitating means if present, electrical connections and so on.

According to a second aspect of the invention, therefore, we provide a gold alloy salt comprising a nitrosulphito gold complex and one or more of the metals copper, nickel, zinc, cobalt, silver, the platinum group metals, cadmium, lead, mercury, arsenic, tin, selenium, tellurium, manganese, magnesium, indium, antimony, iron, bismuth and thallium, in the form of a compound or complex.

A bath using a gold alloy electrodeposition electrolyte or salt according to either of the first two aspects of the invention is characterised by being entirely free from cyanide. We have found, in fact, that the alloying metal with gold may be added either as a compound, for example a non-cyanide salt, as a complex anion or as a suitable complex. An example of a suitable salt anion is sulphite and examples of suitable complexing agents are EDTA and sulphite. Other possible salt anions are nitrite and acetate.

The alloying metals which we prefer to use are copper, cadmium, silver, palladium, cobalt, nickel, arsenic, tin, zinc and indium and, of these, the metals which we particularly prefer to use are copper, nickel, silver, zinc, arsenic, palladium and cadmium.

The relative amounts of gold and alloying metal present are selected according to the properties required of the electro deposit, for example colour, porosity, corrosion resistance and hardness. We have found that for many purposes the ratio by weight of alloying metal to gold need not exceed about 1:10. For example, if the concentration of gold in the electrolyte is 10 $g.l^{-1}$, the concentration of alloying metal would probably be less than 1.0 $g.l^{-1}$.

For some purposes, however, it is desirable to have ratios of alloying metal to gold substantially in excess of 1:10, for example up to about 1:1. For direct electrodeposition of 9 carat gold, for instance, we have found that an electrolyte comprising 50% by weight of gold and 50% by weight of alloying metal or metals, preferably copper, silver, or cadmium, may be satisfactory. For direct electrodeposition of 18 carat gold, on the other hand, we have found that an electrolyte comprising 66% by weight of gold and 33% by weight of alloying metal or metals may be satisfactory. These percentages, however, are variable for a given carat designation and the absolute concentration of alloying metal appears to have more significance than the amount relative to gold.

The invention also includes a method of electrodepositing on a substrate an alloy of gold using an electrolyte according to the first aspect of the invention or an electrodeposition salt of the second aspect.

Conditions of electrodeposition may be caried according to the nature and relative concentration of the alloying metal addition, the thickness of deposit required and so on. The composition of the deposit in terms of the relative proportions of alloying ingredients does not necessarily directly reflect the composition of the electrolyte. We have found, for example, that an electrolyte containing 10 $g.l^{-1}$ of gold and 5 $g.l^{-1}$ copper can yield a deposit containing 81% gold, 18% copper whereas a similar electrolyte but containing 5 $g.l^{-1}$ cobalt instead of copper yields, under similar conditions, a deposit containing approximately 99.8% gold and less than 0.1% cobalt.

The variables of electrodeposition are discussed below.

(a) Agitation. This may be effected for example by solution stirring, movement of the cathode or a combination of the two. Whatever method is used, however, we have found that, in order to obtain a consistent deposit colour from a given electrolyte, the mode and speed of agitation should be held essentially constant.

Other possible modes of agitation are gas bubbling and ultrasonic agitation.

(b) pH. The optimum operating pH for a given electrolyte depends on the nature of the alloying metal. Arsenic, copper and cadmium, for example, form deposits having stable colour at high pH (that is, greater than 11.0) whereas other alloying metals operate more satisfactorily at lower pH. We have found that, in order to operate satisfactorily at lower pH values, additional additives such as polydentate amines may be required.

(c) Current density. We have found that, in general, the effect, if any, of increased current density on the appearance of the deposit depends on the mode of agitation and may increase streaking, edge burning and blooming but may, on the other hand, enable finer control of colour and deposit composition to be achieved.

(d) Temperature. Generally, electrodeposition baths using electrolytes according to the invention can be operated satisfactorily at room temperature although for certain alloying metals, for example palladium, at concentrations in excess of 1 $g.l^{-1}$ in a 10 $g.l^{-1}$ gold electrolyte, higher temperatures in the region of 50° C. may be required.

We have found that, particularly when electrodepositing low carat gold alloys, the electrodeposit is not a true alloy, consisting in practice of particles of alloy mixed with particles of the individual alloying elements to produce zones within the deposit and of varying composition. Under these circumstances it is necessary to homogenise the deposit by a heat treatment; this promotes true alloy formation. Such heat treatments are carried out generally, depending on electrolyte composition, deposit thickness and so on, at 300°-400° C. under a reducing atmosphere, such as 90% $N_2$, 10% $H_2$, for a time typically varying between a few minutes and several hours.

Preparation of electrolytes.

Electrolytes according to the first aspect of the invention may be prepared, for example, by dissolving sufficient of a nitrosulphito gold salt in water to give a solution containing the required concentration of metal, generally 0.1-50 g/l Au, preferably 2-30 g/l Au. Further sodium nitrite or other compatible alkali metal salt may also be added. Sodium hydroxide or another alkali is added to raise the pH to the value required, depending on the nature of the alloying metal. EDTA may be added to reduce the pH, if necessary. Since the pH falls during deposition, a buffer should normally be used, for example $Na_2B_4O_7$ (borax), $Na_2HPO_4$ or $NaHCO_3$ (but preferably $Na_2B_4O_7$) for operation in the range of pH 9-11, or, for example, sodium acetate ($CH_3COONa$) for operation under approximately neutral conditions. The buffer concentration is normally of the order of 10 g/l. A salt, complex or compound containing a complex anion of the alloying metal is added in an amount sufficient to give the required concentration. The salt, complex or compound may be added to the electrolyte directly or in the form of a solution. If necessary, pH re-adjustment may be carried out.

An alternative and preferred method of preparing an electrolyte according to the first aspect of the invention is to dissolve a gold alloy salt according to the second aspect of the invention in water and then to proceed according to the method above. The advantage of this method is that pH adjustment is carried out after all the electrodepositing species have been added and further adjustment is rendered unnecessary.

Gold alloy electrodeposits from these solutions are improved by the addition of chelating agents such as EDTA (ethylenediamine tetraacetic acid). This may be used as such, but is normally added as the sodium or other salt of EDTA.

To obtain bright deposits of gold alloy the addition of a brightener is normally required. Preferred brighteners are those containing arsenic, antimony or selenium. Proprietary brighteners of this type are available, but the most satisfactory brightener can be prepared by reaction of $As_2O_3$ with EDTA. It is within the scope of the invention to include the arsenic in the electrolyte or electrodeposition salt according to the first two aspects of the invention, or to add it separately.

For certain purposes, particularly for electroforming where the alloying metal is present in a relative amount to gold of about 0.03:1 or greater, it is desirable to include a stress relieving agent in the electrolyte. Examples of suitable stress relieving agents are various high boiling organic compounds such as Turkey red oil. Alternatively or additionally, to alleviate stress in the electrodeposit, the technique of pulse electrodeposition may be employed.

Electrolytes according to the invention are suitable for vat and barrel electroplating, and for electroforming, operations and can be operated through many turnovers of the metal content by appropriate replenishment of the gold and alloying metal contents with further plating salt and of the brightener when required, and adjustment of the pH as necessary.

In vat electroplating, the substrate is positioned in the electrolyte in a suitable container and connected in the electric circuit to become the cathode. In barrel electroplating, according to one embodiment, the electrolyte container is in the form of a barrel or beaker, the bottom of which is provided with studs to act as cathodes. The anode generally comprises a central rod of platinised titanium, for example, and the axis of the barrel or beaker is inclined to the vertical. Articles to be electroplated are placed in the container which is then slowly revolved while electroplating takes place. According to another embodiment, a perforated barrel containing the articles to be electroplated is submerged in a reservoir containing the electrolyte. The barrel is caused to rotate and, suitable electrical connections being provided, the articles are tumbled inside the barrel and a deposit of metal or alloy is applied. In electroforming, a fairly thick—that is, from 25$\mu$ to 1000$\mu$, or greater, preferably 100$\mu$ to 500$\mu$,—layer of metal or alloy is deposited on a cathodic substrate which is subsequently removed from the electrodeposit, leaving a hollow article of metal or alloy having high strength and, in shape, faithfully following the relief of the substrate. As an example of a gold or gold alloy electroforming operation, a wax substrate is first coated with a layer of silver by spraying silver nitrate solution and reducing the deposit so formed to metallic silver, the silvered substrate then has a relatively thick layer of gold or gold alloy applied by electrodeposition, the wax is then melted out and the silver dissolved. Alternatively, a copper mandrel may have a relatively thick layer of gold or a gold alloy applied by electrodeposition, the copper subsequently being dissolved.

The following experimental examples and tables are illustrative of the invention.

EXAMPLE 1

This series of experiments illustrates the effect on deposit composition and appearance of adding alloying metals copper, nickel, cobalt, zinc and palladium at various concentrations to a 10 $g.l^{-1}$ gold nitrosulphito electrodeposition electrolyte. The palladium was added as $(Pd(NO_2)_2(NH_3)_2)2$ and the remaining metals as their EDTA complexes.

The copper-EDTA complex was prepared by dissolving copper (11) nitrate (59 g) in water (250 ml) at 50° C. and adding EDTA (90 g) with stirring for 1 hour. The solution was then evaporated without boiling to a volume of 150 ml and, on cooling to 20° C., a blue precipitate formed which was filtered off, washed with acetone and air dried. The yield was 98 g.

For each alloying metal at each concentration, two current densities were investigated. Electroplating was continued for ½ hour for each experiment. In each experiment 10 $ml.l^{-1}$ of brightener was added. The electrolyte pH was 11.4.

Cathode efficiency, deposit composition and appearance are detailed in Table 1.

EXAMPLE 2

Table 2 shows the effect on cathode efficiency and deposit colour of varying the pH of a 10 $g.l^{-1}$ gold nitrosulphito electrolyte to which has been added 2.5 $g.l^{-1}$ and 5.0 $g.l^{-1}$ each of copper (as the EDTA complex) and palladium (as $(Pd(NO_2)_2(NH_3)_2)$). Each experimental deposition was continued for ½ hour during which time the pH and current density remained constant, the latter at a value of 0.144 $Adm.^{-2}$.

EXAMPLE 3

Table 3 illustrates the deposit hardness obtained using electrolytes comprising 5 $g.l^{-1}$ and 10 $g.l^{-1}$ of gold nitrosulphito complex with additions of from 0.05 $g.l^{-1}$ to 5.0 $g.l^{-1}$ of copper at various pH values. Hardness was determined using a Leitz Miniload hardness tester with a loading of 25 g.

EXAMPLE 4

5 $g.l^{-1}$ and 10 $g.l^{-1}$ gold nitrosulphito electrolytes were prepared and operated at a current density of 0.144 $Adm.^{-2}$ and a pH of 11.4 with a range of copper additions. Results are quoted in Table 4*a*. The electrolytes were then used to prepare deposits having a nominal thickness of 5$\mu$ and the physical properties of these deposits are shown in Table 4*b*. The reflectivity figures quoted are for white light and are relative to a 2$\mu$ sputtered deposit of pure gold on an optically flat glass slide.

Percentage reflectivity is generally expressed as $$\frac{\text{intensity of reflected light} \times 100}{\text{intensity of reflected + scattered light}}$$

EXAMPLE 5

In order to determine the composition of deposits, electrolytes comprising 5 $g.l^{-1}$ and 10 $g.l^{-1}$ gold as the nitrosulphito complex and with a range of copper concentrations were operated using the cathode efficiencies from earlier experimental examples to calculate the time required to form a deposit of 0.5 g. Results are quoted in Table 5.

EXAMPLE 6

Vat plating trials.

Table 6 illustrates the results of vat plating trials using electrolytes according to the invention and containing 10 $g.l^{-1}$ gold, 0.02 $g.l^{-1}$ copper, 15 $g.l^{-1}$ gold, 0.02 $g.l^{-1}$ copper and 30 $g.l^{-1}$ gold, 0.02 $g.l^{-1}$ copper respectively compared to the corresponding electrolytes without copper additions. It was found that all deposits for a current density of up to 0.36 $Adm.^{-2}$ for 10 $g.l^{-1}$ gold/0.02 $g.l^{-1}$ copper, up to 0.4 $Adm.^{-2}$ for 15 $g.l^{-1}$ gold/0.02 $g.l^{-1}$ copper and up to 0.8 $Adm.^{-2}$ for 30 $g.l^{-1}$ gold/0.02 $g.l^{-1}$ copper were bright, coherent and adherent. Above these levels the reflectivity decreased slightly and the deposits exhibited mild blooming and edge burning. The samples from the best deposits were analysed and found to contain 99.85 wt.% gold, 0.08–1.0 wt.% copper and <0.08 wt.% arsenic, the latter figure corresponding to the limit of detection of this element.

EXAMPLE 7

Barrel plating trials.

Barrel plating trials were carried out on silver headed copper "Optecon" contact rivets as substrate in a slowly rotating, inclined 500 ml. polythene barrel containing 300 ml. of electrolyte. Electrical contact to the charge was made via studs set into the bottom of the beaker and a centrally immersed strip of platinised titanium was employed as anode. The normal loading was 1000 contacts having an area of 203 $cm^2$ (weight 95.42 g).

Electrolytes containing 10 $g.l^{-1}$ and 15 $g.l^{-1}$ gold, each with addition of 0.02 $g.l^{-1}$ copper and each at a pH of 11.4, were investigated. Results are given in Table 7.

EXAMPLE B

Electroforming.

Electroforming trials were carried out on electrolytes containing 15 $g.l^{-1}$ and 30 $g.l^{-1}$ gold each with addition of 0.02 $g.l^{-1}$ copper. The 15 $g.l^{-1}$ gold-based electrolyte was used to form a nominal 250$\mu$ deposit on a copper panel at pH 11.4 using a current density of 0.4 $Adm.^{-2}$ and mild agitation for 17 hours. The gold, copper and arsenic was "replenished" in advance. A similar deposition was carried out on a panel of smaller area in order to decrease the amount by which the gold, copper and arsenic required to be "replenished" in advance. The panels were dissolved in nitric acid and the deposits assayed for copper (0.1%) and arsenic (<0.08%). Due to the slightly noduled appearance of the deposits, further trials were conducted using continuous electrolyte filtration.

Both electrolytes were used to electroform deposits for 24 hours, in each case for 16 hours at low current density, followed by a further 8 hours on a fresh panel.

A mould was then electroformed to a nominal 250 μm thickness to investigate the relief of the deposit. In each case the deposits were excellent in appearance and mould relief was followed to perfection. The results are given in Table 8.

Deposits formed from electrolytes according to the invention were also tested for porosity, corrosion resistance, solderability and contact resistance. Assessments were also made of deposit stress and electrolyte throwing power. Results are discussed below.

Porosity

Deposits having a range of thickness (<1 to 12.5μ) were prepared on copper panels and tested electrographically using CdS paper and a current density of 0.8 Adm.$^{-2}$. It was found that porosity occurred only in deposits less than 3μ thick.

Corrosion resistance

Samples were exposed in a dessicator to a moist 1% v/v $SO_2$ atmosphere for 24 hours followed by a moist 1% v/v $H_2S$ atmosphere for a similar period. An accelerated test consisted of 30 minutes' exposure to a concentrated atmosphere of ammonium polysulphide. In general, deposits of greater than 2.5–3μ thickness suffered little corrosion.

Solderability

1880μ thick copper wire was plated with varying thicknesses of gold alloy and lowered horizontally into a 200 mg block of melted solder, both wire and solder being fluxed. The solderability was determined by measuring the time taken for the solder to flow completely around the wire. It was found that, of the electrolytes tested (5 g.l$^{-1}$ gold with 0.02 g.l$^{-1}$, 0.05 g.l$^{-1}$, 0.15 g.l$^{-1}$ and 0.35 g.l$^{-1}$ copper respectively), soldering times were lowest for the 0.05 g.l$^{-1}$ copper electrolyte but higher copper levels still resulted in lower soldering times than did the 0.02 g.l$^{-1}$ copper electrolyte.

Contact Resistance

Pairs of contacts plated with 5, 7.5 and 10μ deposits respectively from 10 g.l$^{-1}$ gold/0.02 g.l$^{-1}$ copper and 15 g.l$^{-1}$ gold/0.02 g.l$^{-1}$ copper electrolytes were measured for contact resistance by holding each pair together with a force of 0.1 and 0.25 Newtons and measuring the voltage drop, for each force, when a current of 0.5 A was passed. It was found that deposits from these electrolytes had substantially better contact resistance (i.e. higher) than corresponding deposits from electrolytes comprising nitrosulphito gold salts without any copper.

Stress

A strip of fully annealed beryllium copper (Be/Cu 10×0.9×0.01 cm) was masked on one side with "Donodep" stopping off paint and suspended vertically from a rigid clamp. The deflection of the strip when plated with a 12.5μ deposit of gold or gold alloy is indicative of the stress of the deposit. It was found that addition of copper to a 10 g.l$^{-1}$ gold electrolyte caused an increase in stress but the effect lessened as the concentration of gold was increased to 15 g.l$^{-1}$ and 30 g.l$^{-1}$.

Throwing Power

Throwing power may be defined as the percentage ratio of the smallest and largest coating thicknesses at particular points on an object. We have found that the throwing power of electrolytes according to the invention and containing 0.02 g.l$^{-1}$ copper is superior to nitrosulphito gold electrolytes without any copper. Depolarising agents may be used if required to increase still further the throwing power.

Table 1

| METAL | gl$^{-1}$ | CURRENT DENSITY A.dm. − 2 | C.E. (%) | DEPOSIT COMPOSITION | APPEARANCE |
|---|---|---|---|---|---|
| Cu | 0.1 | 0.144 | 95.0 | 99.8% Au, 0.15% Cu, <0.05% As | Bright, coherent, adherent. |
| | | 0.288 | 95.0 | | |
| | 0.5 | 0.144 | 69.3 | 98% Au, 1.2% Cu, <0.08% As | Bright, rose colour, coherent, adherent |
| | | 0.288 | 69.1 | | but stressed. |
| | 1.0 | 0.144 | 43.2 | 90% Au, 9% Cu, 0.1% As | Dull pink colour at 0.288A.dm$^{-2}$, rose at |
| | | 0.288 | 45.4 | | 0.144Δ.dm−2, coherent, adherent, stressed |
| | 5.0 | 0.144 | 30.7 | 81.3% Au, 18% Cu, <0.08% As | Dull pink at both, coherent, adherent but |
| | | 0.288 | 36.0 | | Stressed. |
| Ni | 0.1 | 0.144 | 98.0 | 99.8% Au, 0.15% As, <0.05% Ni | Bright, coherent, adherent. |
| | | 0.288 | 99.0 | | Bright with slight streaking. |
| | 0.5 | 0.144 | 94.0 | " | Very bright, coherent, adherent. |
| | | 0.288 | 95.0 | | |
| | 1.0 | 0.144 | 95.0 | " | Very bright, coherent, adherent, gold colour |
| | | 0.288 | 95.0 | | considerably lighter. |
| | 5.0 | 0.144 | 97.0 | 99.8% Au, <0.08% As, 0.12% Ni | Very bright, light coloured deposit, highly |
| | | 0.288 | 89.0 | | stressed. |
| Co | 0.1 | 0.144 | 96.0 | approx 99.8% Au, 0.1% As, <0.1% Co | At 0.144Δ.dm −2 the deposits were very bright |
| | | 0.288 | 96.0 | | whilst at 0.288Δ.dm −2 slight edge burning |
| | 0.5 | 0.144 | 96.0 | " | took place. |
| | | 0.288 | 96.0 | | |
| | 1.0 | 0.144 | 94.0 | " | |
| | | 0.288 | 95.0 | | |
| | 5.0 | 0.144 | 90.0 | " | |
| | | 0.288 | 91.0 | | |
| Zn | 0.1 | 0.144 | 89.0 | 99.8% Au, 0.15% As, Zn not detected | At 0.144Δ.dm−2 all deposits bright whilst at |
| | | 0.288 | 94.0 | | 0.288Δ.dm−2 all deposits badly bloomed. |
| | 0.5 | 0.144 | 96.0 | " | |
| | | 0.288 | 95.0 | | |
| | 1.0 | 0.144 | 98.0 | " | |
| | | 0.288 | 96.0 | | |
| | 5.0 | 0.144 | 94.0 | " | |
| | | 0.288 | 99.0 | | |
| Pd | 0.1 | 0.144 | 94.0 | 99.78% Au, 0.1% Pd, 0.1% As | Bright, coherent, adherent. |

Table 1-continued

| METAL | $gl^{-1}$ | CURRENT DENSITY A.dm. − 2 | C.E. (%) | DEPOSIT COMPOSITION | APPEARANCE |
|---|---|---|---|---|---|
| | | 0.288 | 98.0 | | " |
| | 0.5 | 0.144 | 90.0 | 99.8% Au, 0.1% Pd, <0.08% As | " |
| | | 0.288 | 91.0 | | Slight bloom, coherent, adherent. |
| | 1.0 | 0.144 | 86.0 | 99% Au, 0.85% Pd, <0.08% As | Gold was light in colour at both current |
| | | 0.288 | 84.0 | | densities. |
| | 5.0 | 0.144 | 54.0 | 92% Au, 7.8% Pd, 1.0% As | Very light, highly stressed deposit. |

Table 2

| Concentration G1-1 | Solution pH | Cathode efficiency % | Deposit colour |
|---|---|---|---|
| 2.5 Cu | 10 | 52 | bright rose - copper |
| | 11 | 51 | bright rose - red |
| | 12 | 42 | copper red, yellow streak |
| | 13 | 41 | copper red, yellow streak |
| 5.0 Cu | 10 | 35 | bright copper |
| | 11 | 32 | " |
| | 12 | 30 | " |
| | 13 | 28 | " |
| 2.5 Pd | 10 | 74 | light palladium |
| | 11 | 76 | very light palladium |
| | 12 | 85 | grey - yellow |
| | 13 | 86 | " |
| 5.0 Pd | 10 | 50 | bright palladium |
| | 11 | 47 | " |
| | 12 | 53 | " |
| | 13 | 55 | dull grey yellow |

Table 3

| (Au) pH | 5gl-1 10.4 | 10gl-1 10.4 | 5gl-1 11.4 | 10gl-1 11.4 | 5gl-1 12.4 | 10gl-1 12.4 |
|---|---|---|---|---|---|---|
| Copper concentration gl-1 | ← | ← | Hardness | VPN→ | → | → |
| 0.05 | 170–180 | 195–210 | 180–185 | 175–185 | 140–150 | 150–160 |
| 0.1 | 175–185 | 195–205 | 175–185 | 185–190 | 130–150 | 145–160 |
| 0.2 | 170–185 | 200–210 | 175–185 | 190–200 | 130–150 | 130–150 |
| 0.25 | 180–190 | 210–215 | 180–200 | 185–210 | 140–160 | 150–160 |
| 0.3 | 180–190 | 230–245 | 180–200 | 205–210 | 150–160 | 140–160 |
| 0.4 | 200–220 | 240–245 | 200–210 | 195–205 | 150–153 | 130–170 |
| 0.5 | 200–220 | 230–250 | 200–210 | 200–205 | 130–160 | 150–160 |
| 0.75 | 210–240 | 250–265 | 210–230 | 200–210 | 150–170 | 145–150 |
| 1.0 | 220–230 | 280–290 | 220–240 | 215–230 | 160–170 | 155–160 |
| 1.5 | 220–240 | 280–290 | 230–240 | 225–250 | 150–170 | 150–160 |
| 2.0 | 250–270 | 280–290 | 240–260 | 235–250 | 170–180 | 180–185 |
| 2.5 | 260–270 | 290–320 | 240–260 | 295–310 | 170–180 | 160–180 |
| 5.0 | 280–290 | 320–330 | 260–270 | 290–310 | 170–180 | 170–190 |

Table 4

| Gold Concentration gl-l | Copper Concentration gl-l | Cathode Efficiency % | Deposit Thickness µm | Deposit Appearance, Visual |
|---|---|---|---|---|
| 5 | 0 | 87 | 6.4 | very bright yellow |
| 10 | " | 90 | 6.5 | |
| 5 | 0.05 | 88 | 6.4 | very bright off yellow |

Table 4-continued

| Gold Concentration gl-l | Copper Concentration gl-l | Cathode Efficiency % | Deposit Thickness µm | Deposit Appearance, Visual |
|---|---|---|---|---|
| 10 | " | 89 | 6.5 | |
| 5 | 0.1 | 80 | 6.0 | very bright brass |
| 10 | " | 80 | 6.0 | yellow |
| 5 | 0.2 | 72 | 5.4 | bright very light pink |
| 10 | " | 76 | 5.5 | |
| 5 | 0.25 | 73 | 5.4 | bright very light pink |
| 10 | " | 76 | 5.5 | |
| 5 | 0.3 | 70 | 5.3 | very bright light pink |
| 10 | " | 76 | 5.5 | |
| 5 | 0.4 | 64 | 5.0 | very bright light pink |
| 10 | " | 68 | 5.— | |
| 5 | 0.5 | 62 | 4.9 | bright deep pink |
| 10 | " | 68 | 5.1 | |
| 5 | 0.75 | 50 | 3.9 | bright red gold |
| 10 | " | 52 | 3.9 | |
| 5 | 1.0 | 34 | 2.6 | very bright red gold |
| 10 | " | 36 | 2.6 | |
| 5 | 1.5 | 31 | 2.4 | very bright red gold |
| 10 | " | 36 | 2.6 | |
| 5 | 2.0 | 30 | 2.4 | bright deep red |
| 10 | " | 35 | 2.6 | |
| 5 | 2.5 | 30 | 2.4 | bright deep red |
| 10 | " | 35 | 2.6 | |
| 5 | 5.0 | 28 | 2.1 | copper colour |
| 10 | " | 30 | 2.2 | |

TABLE 5

| Gold Concentration $gl^{-1}$ | Copper Concentration $gl^{-1}$ | Deposit Thickness µm | Hardness VPN | Reflectivity % white light | Porosity and Cracking |
|---|---|---|---|---|---|
| 5 | 0 | 5.0 | 125–150 | 98 | nil |
| 10 | " | 5.1 | 130–150 | 98 | nil |
| 5 | 0.5 | | 160–170 | 95 | nil |
| 10 | " | 4.9 | 175–185 | 94 | nil |
| 5 | 0.1 | | 170–175 | 95 | nil |
| 10 | " | 4.9 | 185–190 | 96 | nil |
| 5 | 0.2 | | 185–195 | 95 | nil |
| 10 | " | 5.2 | 190–200 | 94 | nil |
| 5 | 0.25 | | 185–195 | 95 | very mild porosity |

TABLE 5-continued

| Gold Concentration $gl^{-1}$ | Copper Concentration $gl^{-1}$ | Deposit Thickness μm | Hardness VPN | Reflectivity % white light | Porosity and Cracking |
|---|---|---|---|---|---|
| 10 | " | 4.8 | 185–210 | 96 | " |
| 5 | 0.3 | | 175–195 | 94 | very light edge cracking and porosity |
| 10 | " | 5.2 | 195–205 | 97 | |
| 5 | 0.4 | | 190–200 | 92 | edge cracking and porosity |
| 10 | " | 5.1 | 205–210 | 90 | |
| 5 | 0.5 | | 185–200 | 91 | edge cracking and porosity |
| 10 | " | 5.0 | 200–205 | 88 | |
| 5 | 0.75 | | 190–200 | 82 | badly edge cracked and very porous |
| 10 | " | 5.1 | 200–210 | 86 | |
| 5 | 1.0 | | 200–205 | 81 | very cracked deposit |
| 10 | " | 5.0 | 215–230 | 84 | |
| 5 | 1.5 | | 215–250 | 82 | very cracked deposit |
| 10 | " | 5.0 | 225–250 | 81 | |
| 5 | 2.0 | | 220–230 | 83 | very badly cracked deposit |
| 10 | " | 4.9 | 235–250 | 80 | |
| 5 | 2.5 | | 260–275 | 80 | crazed deposit |
| 10 | " | 4.9 | 295–310 | 80 | |
| 5 | 5.0 | | 280–300 | 72 | crazed deposit |
| 10 | " | 5.0 | 290–310 | 70 | |

Table 6

| Deposit thickness | Solder Time (Second), $5gl^{-1}$ Au | | | |
|---|---|---|---|---|
| μm | Cu, $0.02gl^{-1}$ | Cu, $0.05gl^{-1}$ | Cu, $0.15gl^{-1}$ | Cu, $0.35gl^{-1}$ |
| 0.0 | 4.76 | 4.78 | 4,76 | 4.76 |
| 0.5 | 5.62 | 3.6 | 3.8 | 4.6 |
| 1.0 | 3.7 | 2.4 | 2.8 | 3.1 |
| 1.5 | 3.6 | 1.38 | 2.1 | 2.4 |
| 2.0 | 3.85 | 0.85 | 1.2 | 1.24 |
| 2.5 | 3.8 | 0.31 | 1.3 | 1.45 |
| 3.0 | 4.72 | 0.58 | 1.4 | 2.1 |
| 5.0 | 4.0 | 0.35 | 0.98 | 2.05 |

TABLE 7

| Electrolyte | | | Deposit | | | |
|---|---|---|---|---|---|---|
| Gold Concentration $gl^{-1}$ | Copper addition $gl^{-1}$ | Cathod Efficiency % | Gold % | Copper % | Arsenic % | carat |
| 5 | 0.02 | 88 | 99.85 | 0.1 | > 90.08 | 24 |
| 10 | " | 90 | 98.85 | 0.1 | > 80.08 | |
| 5 | 1.0 | 35 | 87.5 | 11.68 | 0.82 | 21 |
| 10 | " | 36 | 87.8 | 11.4 | 0.80 | 21 |
| 5 | 1.5 | 31 | 82.8 | 15.9 | 1.50 | 19.8 |
| 10 | " | 36 | 83.4 | 15.1 | 1.50 | 20.0 |
| 5 | 2.5 | 30 | 74.2 | 23.6 | 2.2 | 17.8 |
| 10 | " | 35 | 74.1 | 23.7 | 2.2 | 17.8 |
| 5 | 5.0 | 28 | 40.0 | 54.4 | 5.8 | 9.6 |
| 10 | " | 30 | 39.2 | 54.3 | 6.5 | 9.4 |

What we claim is:

1. A cyanide-free mixture for compounding an electroplating solution for the electrodeposition of gold alloys consisting essentially of a nitrosulphito gold complex and at least one member of the group consisting of copper, nickel, zinc, cobalt, silver, the platinum group metals, cadmium, lead, mercury, arsenic, tin, selenium, tellurium, manganese, magnesium, indium, antimony, iron, bismuth and thallium, in the form of a sulphite, the amount of gold relative to the amount of metal being up to 2:1.

* * * * *

UNITED STATES PATENT AND TRADEMARK OFFICE

CERTIFICATE OF CORRECTION

PATENT NO. : 4,199,416

DATED : April 22, 1980

INVENTOR(S) : Harry Middleton and Paul C. Hydes

It is certified that error appears in the above-identified patent and that said Letters Patent are hereby corrected as shown below:

Under Item [30] the second British Priority No. should be --13316/78-- rather than "13116/78"

Signed and Sealed this

*Fifth* Day of *August 1980*

[SEAL]

*Attest:*

SIDNEY A. DIAMOND

*Attesting Officer*

*Commissioner of Patents and Trademarks*